US012234994B2

(12) United States Patent
Schultz

(10) Patent No.: US 12,234,994 B2
(45) Date of Patent: Feb. 25, 2025

(54) COOKTOP GRATE SUPPORT

(71) Applicant: WHIRLPOOL CORPORATION, Benton Harbor, MI (US)

(72) Inventor: Rodrigo Schultz, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 395 days.

(21) Appl. No.: 17/713,630

(22) Filed: Apr. 5, 2022

(65) Prior Publication Data

US 2023/0314007 A1 Oct. 5, 2023

(51) Int. Cl.
*F24C 15/10* (2006.01)

(52) U.S. Cl.
CPC ..... *F24C 15/107* (2013.01)

(58) Field of Classification Search
CPC ..... F24C 15/107; F24C 15/10; F24C 3/085; F16M 2200/08; F16M 11/36; F16M 2200/02; F16M 2200/028; F16M 11/247; A47B 91/04; A47B 91/00; A47C 7/002
USPC ..... 126/215, 152, 5 R, 214 C, 212, 40; 248/615, 188.9, 677, 188.8, 188.2
See application file for complete search history.

(56) References Cited

U.S. PATENT DOCUMENTS

| | | | | |
|---|---|---|---|---|
| 9,612,021 | B2 * | 4/2017 | Wood | F24C 15/107 |
| 10,533,753 | B2 * | 1/2020 | Lando | F24C 15/107 |
| 11,029,037 | B2 * | 6/2021 | Tonietto | F16L 59/02 |
| 11,149,957 | B2 * | 10/2021 | Sloyer | F23H 17/08 |
| 2012/0048258 | A1 * | 3/2012 | Sewell | F24C 15/107 126/152 A |
| 2015/0308696 | A1 * | 10/2015 | Wang | F24C 15/107 126/215 |

FOREIGN PATENT DOCUMENTS

| | | | | |
|---|---|---|---|---|
| CN | 105444227 | A | 3/2016 | |
| CN | 208606228 | U | 3/2019 | |
| CN | 110836394 | A * | 2/2020 | |
| CN | 214120150 | U | 9/2021 | |
| EP | 2253889 | A1 * | 11/2010 | F24C 15/107 |
| EP | 2436988 | A2 | 4/2012 | |
| KR | 2006134709 | A * | 12/2006 | F24C 15/107 |
| WO | WO-2004023043 | A1 * | 3/2004 | F24C 15/00 |

OTHER PUBLICATIONS

English Translation of KR-2006134709 (Year: 2006).*
English Translation of EP-2253889 (Year: 2010).*

* cited by examiner

*Primary Examiner* — Steven B McAllister
*Assistant Examiner* — Amy Elizabeth Carter
(74) *Attorney, Agent, or Firm* — Brooks Kushman P.C.

(57) ABSTRACT

A cooking vessel support for a burner includes a grate and a support foot. The grate has a top surface configured to support a cooking vessel and a lower surface configured for disposal along an upper surface of a cooking appliance. The lower surface defines a cavity. The support foot is disposed within the cavity, has a first protrusion disposed within a first portion of the cavity, has a second protrusion disposed within a second portion of the cavity, and has pad disposed within a third portion of the cavity. The first protrusion is secured to the pad along a side of the pad. The first and second protrusions are configured to engage first and second internal surfaces of the grate within the first and second portions of the cavity, respectively, to restrict movement of the base support in first and second directions, respectively.

18 Claims, 5 Drawing Sheets

COOKTOP GRATE SUPPORT

TECHNICAL FIELD

The present disclosure relates to cooktops and grate supports that are associated with cooktop burners.

BACKGROUND

A cooking appliance is used to cook meals and other foodstuffs on a cooktop or within an oven.

SUMMARY

A cooking vessel support for a burner includes a grate and a plurality of base supports. The grate has a top surface that is configured to support a cooking vessel and at least one lower surface configured for disposal along an upper surface of a cooking appliance. The at least one lower surface defines a plurality of cavities. Each cavity has first, second, and third portions. Each of the plurality of base supports are disposed within a respective cavity of the plurality of cavities, have a column disposed within the first portion of the respective cavity, have a beam disposed within the second portion of the respective cavity, and have pad disposed within the third portion of the respective cavity. Each pad extends outward from a side of a respective column, extends downward from a bottom of a respective beam, and has a bottom surface configured to engage the upper surface of the cooking appliance. The first and second portions of each cavity are respectively shaped to interact with the column and the beam of a respective base support disposed therein to respectively restrict horizontal movement and vertical movement of the respective base support.

A cooking vessel support for a burner includes a grate and a support foot. The grate has a top surface configured to support a cooking vessel and a lower surface configured for disposal along an upper surface of a cooking appliance. The lower surface defines a cavity. The support foot is disposed within the cavity, has a first protrusion disposed within a first portion of the cavity, has a second protrusion disposed within a second portion of the cavity, and has pad disposed within a third portion of the cavity. The first protrusion is secured to the pad along a side of the pad. The second protrusion is secured to the pad along a top of the pad. The pad has a bottom surface configured to engage the upper surface of the cooking appliance. The first and second protrusions are configured to engage first and second internal surfaces of the grate within the first and second portions of the cavity, respectively, to restrict movement of the base support in first and second directions, respectively.

A cooktop grate support foot includes a resting pad, a beam, and a column. The resting pad has a bottom surface configured to engage an upper surface of a cooking appliance. The beam is secured to a top of the resting pad. The column is secured to sides of the resting pad and the beam. The beam and the column are configured to engage internal surfaces defined within an orifice of a cooktop grate to restrict movement of the cooktop grate support foot in first and second directions relative to the cooktop grate, respectively.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
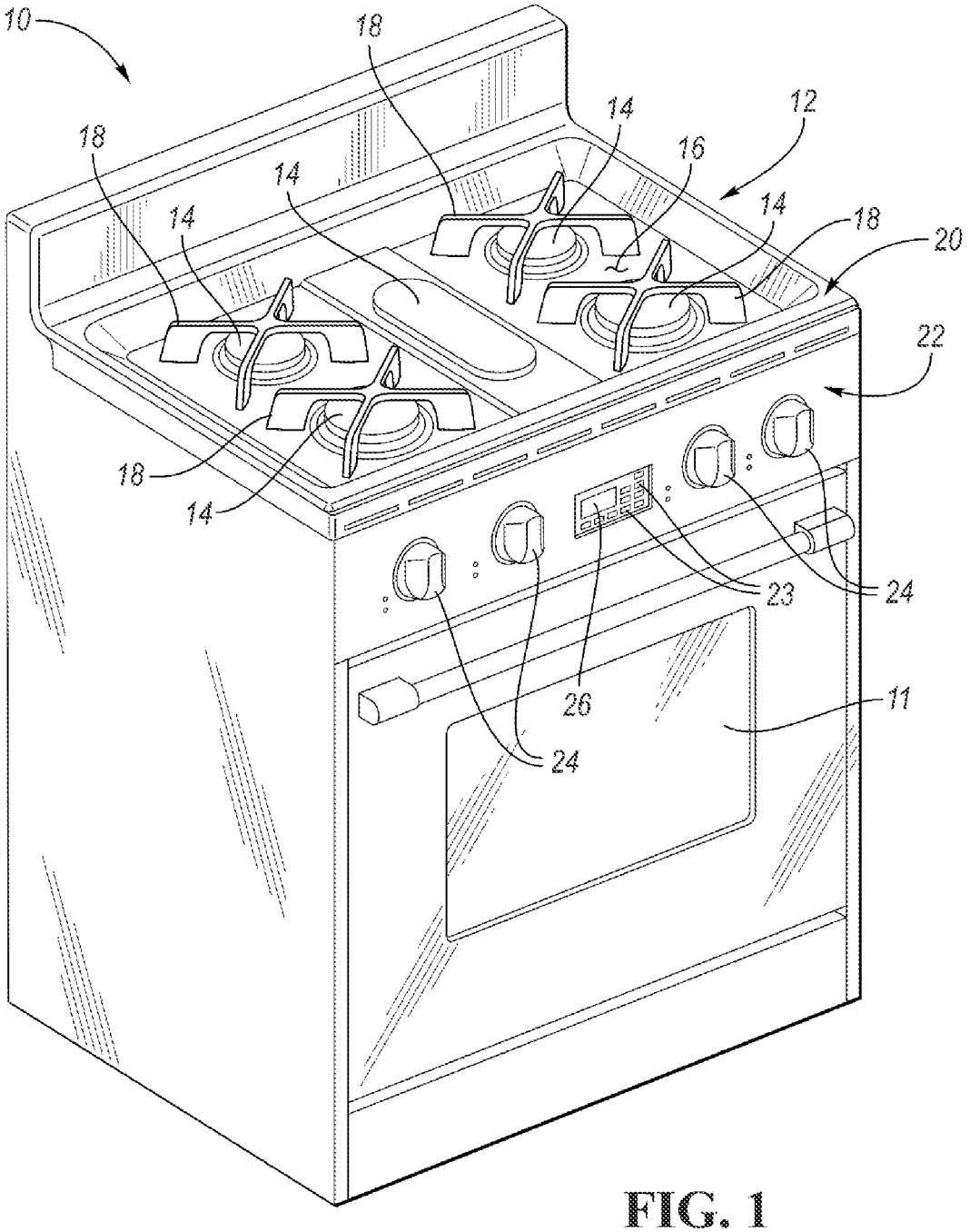
FIG. 1 is a front isometric view of a cooking appliance, according to an aspect of the present disclosure.

Referring to FIG. 1, an appliance 10, such as an oven or stove having a cooktop 12 is illustrated. One or more cooking burners 14 extend from a top or upper surface 16 of the cooking appliance 10. More specifically, the upper surface 16 may be the top or upper surface of the cooktop 12. The upper surface 16 may also be recessed. The appliance 10 is shown in the form of a range that includes the cooktop 12 and an oven 11 in a single unit, but may also be in the form of a stand-alone cooking hob or the like. The appliance 10 can be generally similar to known cooking appliances, including the construction and arrangement of the above-mentioned cooking burners 14. However, other cooking burner arrangements may be utilized. For example, the cooking burner arrangement may include one cooking burner 14 or multiple cooking burners 14.

The cooking burners 14 may be of any type and may be used in connection with cooking vessel supports 18. Each cooking vessel support 18 may be positioned over one of the burners 14 to support a cooking article or vessel, such as a pan, a pot, or the like, above and/or spaced-apart from the cooking burner 14 with which it is used. In general, fuel-burning burners (e.g., those that rely on combustion of natural or propane gas for the generation of heat) are used in conjunction with the cooking vessel supports 18. Numerous types and configurations of cooking burners that are known or may be developed may be utilized as the cooking burners 14, including various types of "hybrid" burners, which may generate heat by multiple means, including fuel-burning and/or electrical heating. The cooking vessel supports 18 may simply rest on top of the upper surface 16 and may be easily removed to allow for easy access to portions of the cooktop 12 underlying the cooking vessel supports 18, as well as the cooking burners 14, specifically for cleaning or maintenance service.

The cooktop 12 may have a base portion 20 that defines the upper surface 16 and receives the burners 14. The base portion 20 may be similar to known structures for similar components of a cooking appliance 14 and may be of any structure that can sufficiently support the cooking vessel supports 18 and any cooking articles or vessels disposed on the cooking vessel supports 18. The base portion 20 may also be generally structured to provide support and a location for the cooking burners 14 and may conceal the various lines and controls associated with the cooking burners 14. The base portion 20 may be formed from a metal sheet via a stamping or other process, that shapes the base portion 20 into the desired three-dimensional shape. Such metal may be steel, stainless steel, aluminum, or the like, and may be of a gauge high enough to provide structural stability, given the particular material characteristics, without unnecessarily increasing weight or difficulty of the manufacture thereof.

The appliance 14 may include a control panel or human machine interface (HMI) 22 and a controller that is in communication with the HMI 22. The HMI 22 may include a touchscreen, buttons 23, dials, or knobs 24 that are configured to operate the oven 11 and the burners 14 of the appliance 10. More specifically, the touchscreen, buttons 23, dials, or knobs 24 may be adjusted by a user to select a desired operational setting of the oven 11 or the burners 14. For example, a cooking temperature of the oven 11 may be selected via engagement of the buttons 23 or a low, medium, or high heat setting for a particular burner 14 may be selected via engagement of a particular knob 24 associated with the particular burner 14. The HMI 22 may communicate the desired operational setting of the oven 11 or the burners 14, set by the user via engagement of the touchscreen, buttons 23, dials, or knobs 24, to the controller, which may then adjust heating elements within the oven 11 or the burners 14 to the desired setting. The controller may include control logic or an algorithm that is configured to adjust heating elements within the oven 11 or the burners 14 to the desired setting based on the desired operational setting of the oven 11 or the burners 14 received from the HMI 22. Alternatively, if the burners 14 are fuel-burning burners, each dial or knob 24 may directly adjust the desired operational setting (e.g., low, medium, or high heat settings) of a particular burner 14 by opening, closing, or adjusting a position a valve that feeds fuel to the particular burner 14. It is noted that there may be intermediate settings between low, medium, or high heat settings for each burner 14. The HMI 22 may also include a display screen 26 that is configured to display an operating condition, such as a set or current temperature of the oven 11.

The controller may be part of a larger control system and may be controlled by various other controllers throughout the appliance 10. It should therefore be understood that the controller and one or more other controllers can collectively be referred to as a "controller" that controls various actuators in response to signals from various sensors to control functions of the appliance 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the appliance 10.

Control logic or functions performed by the controller may be represented by flow charts or similar diagrams in one or more figures. These figures provide representative control strategies and/or logic that may be implemented using one or more processing strategies such as event-driven, interrupt-driven, multi-tasking, multi-threading, and the like. As such, various steps or functions illustrated may be performed in the sequence illustrated, in parallel, or in some cases omitted. Although not always explicitly illustrated, one of ordinary skill in the art will recognize that one or more of the illustrated steps or functions may be repeatedly performed depending upon the particular processing strategy being used. Similarly, the order of processing is not necessarily required to achieve the features and advantages described herein, but is provided for ease of illustration and description. The control logic may be implemented primarily in software executed by a microprocessor-based controller. Of course, the control logic may be implemented in software, hardware, or a combination of software and hardware in one or more controllers depending upon the particular application. When implemented in software, the control logic may be provided in one or more computer-readable storage devices or media having stored data representing code or instructions executed by a computer to control the appliance 10. The computer-readable storage devices or media may include one or more of a number of known physical devices which utilize electric, magnetic, and/or optical storage to keep executable instructions and associated calibration information, operating variables, and the like.

Figure 2:
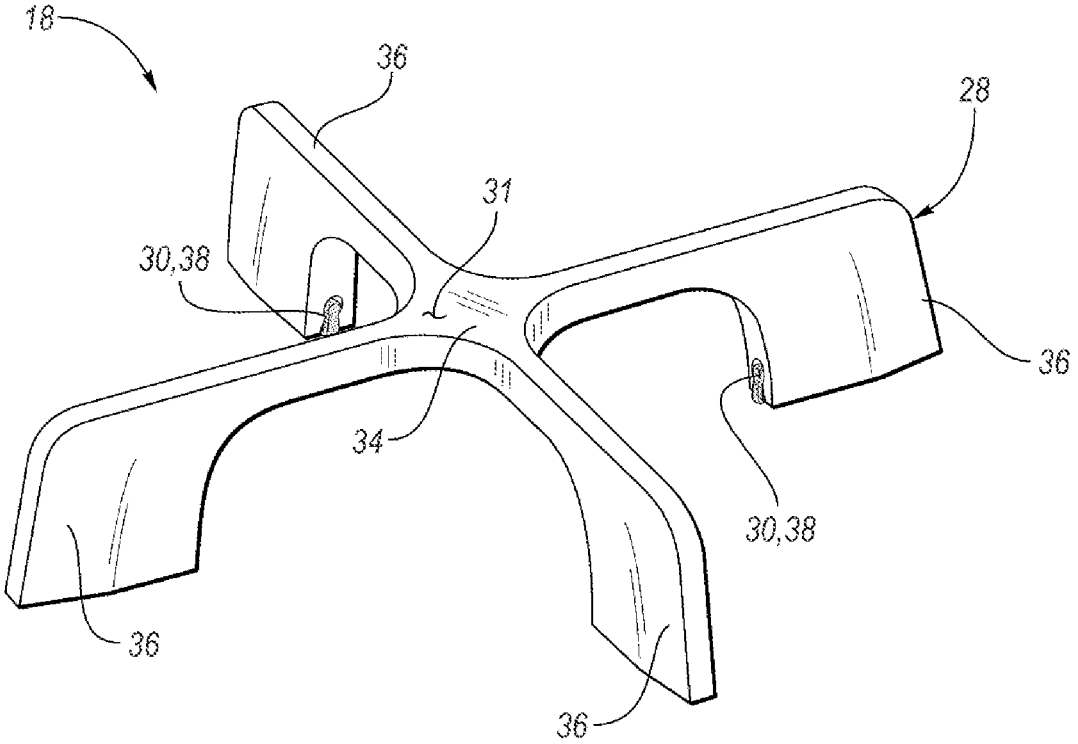
FIG. 2 is a top isometric view of a cooking vessel support.
Figure 3:
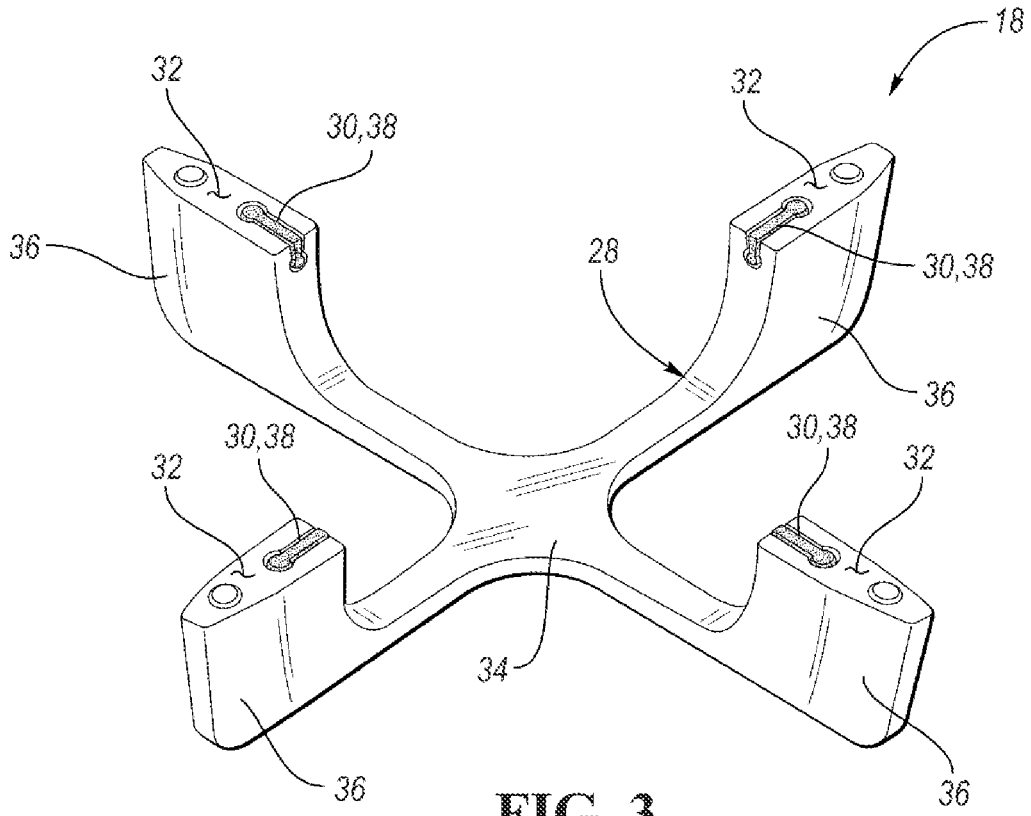
FIG. 3 is a bottom isometric view of the cooking vessel support.

Referring to FIGS. 2 and 3, one of the cooking vessel supports 18 are illustrated in further detail. The cooking vessel support 18 described may be representative of each cooking vessel 18 disclosed herein. For example, the cooking vessel support 18 may be representative of each cooking vessel support 18 illustrated in FIG. 1. The cooking vessel support 18 has a grate 28. The grate 28 may also be referred to as the cooktop grate support. The cooking vessel support 18 also has a plurality of support feet 30. The support feet 30 may also be referred to as base supports or cooktop grate support feet. The grate 28 has a top surface 31 that is configured to support a cooking article or vessel, such as a pan, a pot, or the like. The top surface 31 is configured to be positioned above and spaced-apart from a respective cooking burner 14 with which it is used. The grate 28 also includes one or more lower surfaces 32 that are configured for disposal along the upper surface 16 of the cooking appliance 10 when positioned over a respective cooking burner 14 with which it is used. The grate 28 may include a hub 34 and spokes 36 that protrude outward from the hub 34. The one or more lower surfaces 32 may be defined along bottoms of the spokes 36 and radially outward from the hub 34. The one or more lower surfaces 32 define one or more orifices or cavities 38. More specifically, each cavity 38 may be defined by the one of the spokes 36. Each support foot 30 is disposed within one of the cavities 38.

Figure 4:
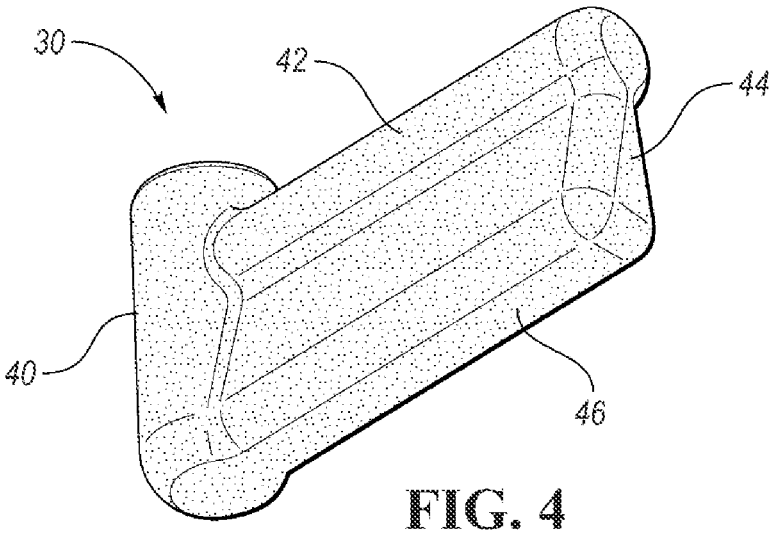
FIG. 4 is a bottom isometric view of a support foot of the cooking vessel support.
Figure 5:
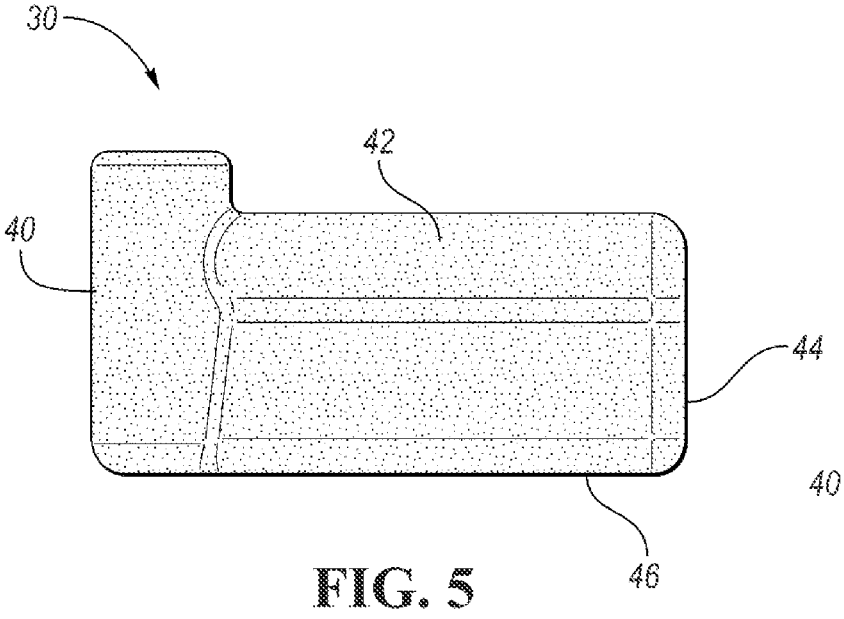
FIG. 5 is a side view of the support foot.
Figure 6:
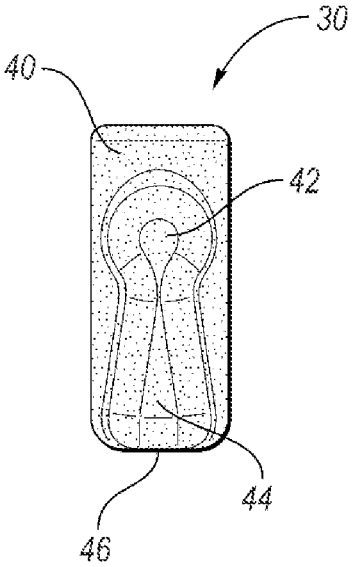
FIG. 6 is a front view of the support foot.
Figure 7:
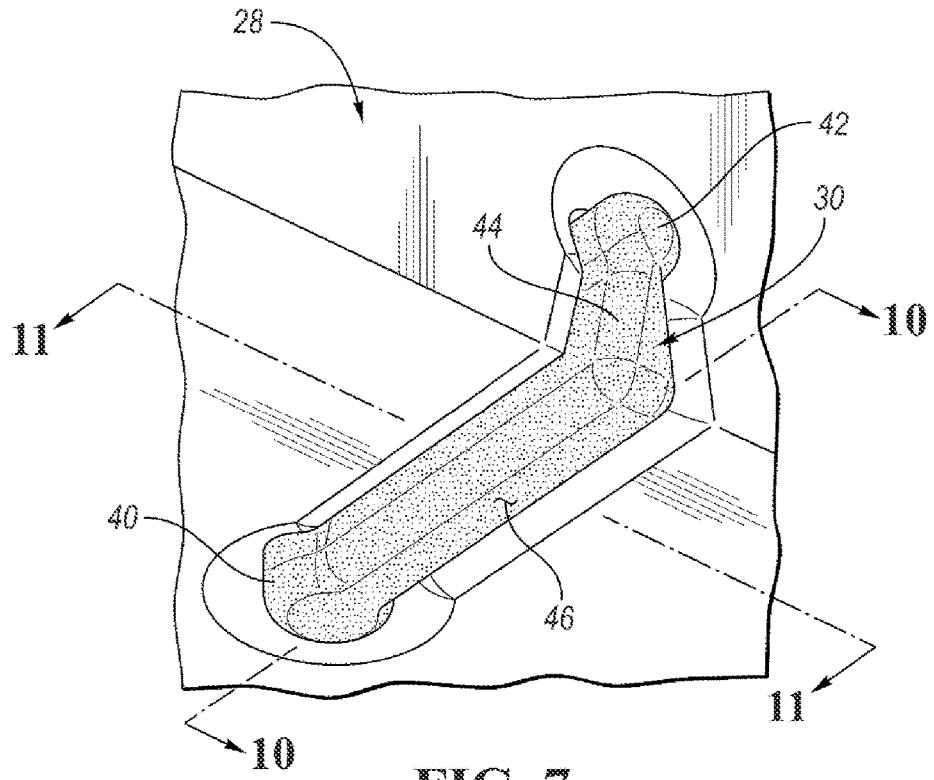
FIG. 7 is a bottom isometric view of the support foot disposed within a cavity defined by a grate of the cooking vessel support.
Figure 8:
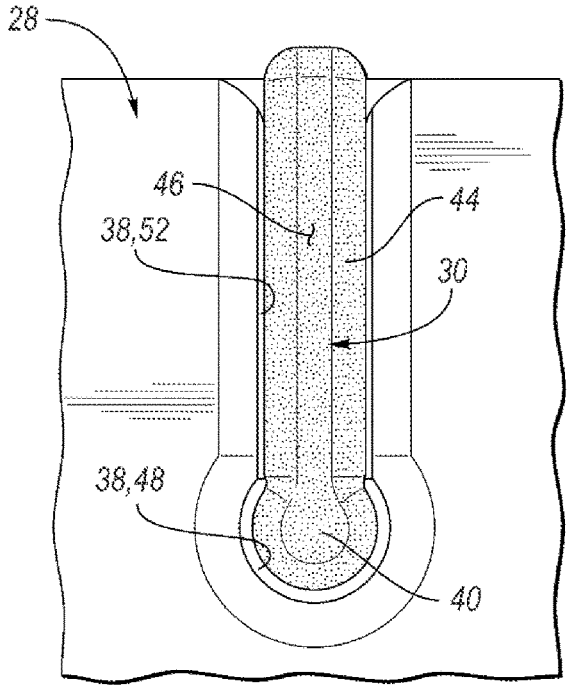
FIG. 8 is a bottom view of the support foot disposed within the cavity defined by the grate.
Figure 9:
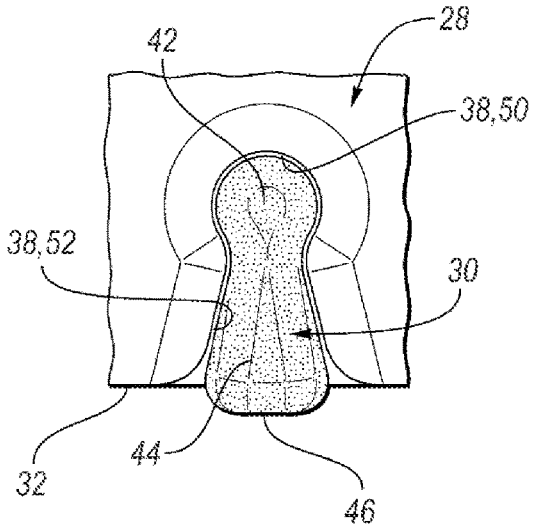
FIG. 9 is a front view of the support foot disposed within the cavity defined by the grate.
Figure 10:
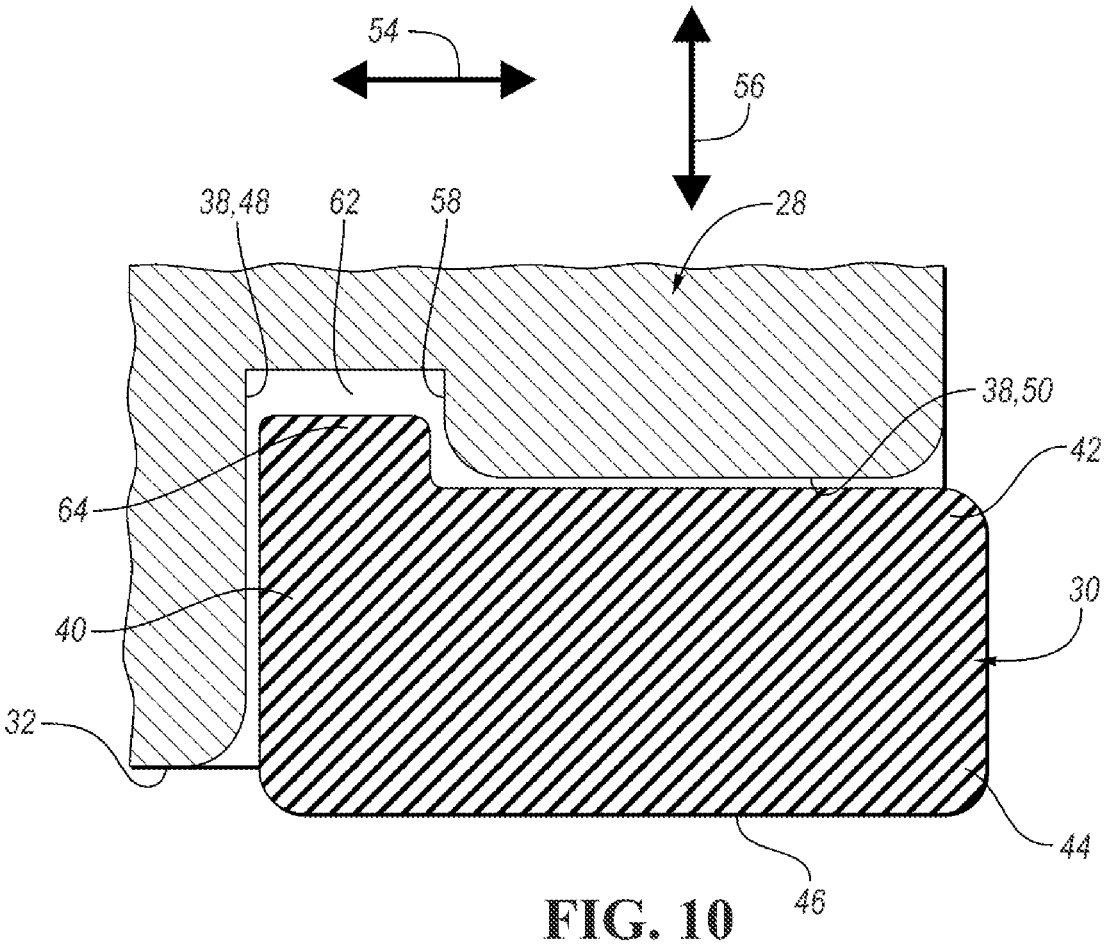
FIG. 10 is a cross-sectional view taken along line 10-10 in FIGS. 7.
Figure 11:
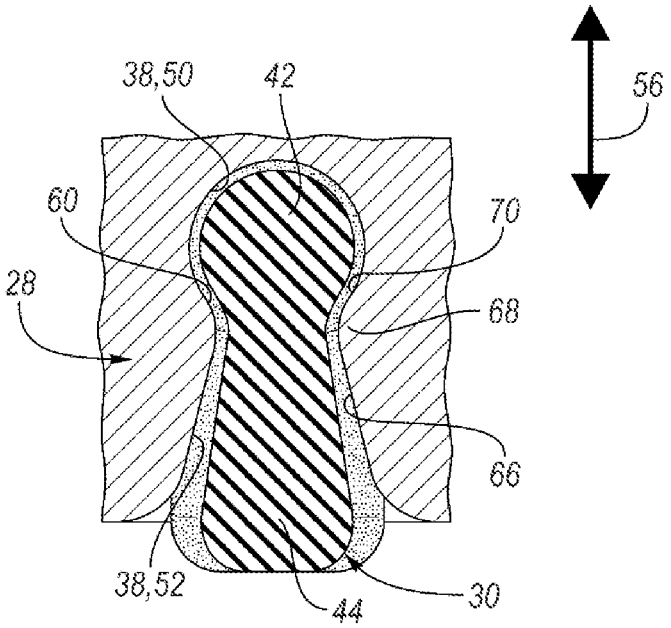
FIG. 11 is a cross-sectional view taken along line 11-11 in FIG. 7.

Referring now to FIG. 4-6, one of the support feet 30 are illustrated in further detail. The support foot 30 descried may be representative of each support foot 30 for each vessel support 18 disclosed herein. For example, the support foot 30 may be representative of each support foot 30 illustrated in FIGS. 2-3. The support foot 30 has a first protrusion 40, and second protrusion 42, and a pad 44. The first protrusion 40 may also be referred to as a column, the second protrusion 42 may also be referred to as a bean, and the pad 44 may also be referred to as a support pad. The pad 44 extends outward from a side of the first protrusion 40 and downward from a bottom of the second protrusion 42. Stated in other terms, the first protrusion 40 is secured to the pad 44 along a side of the pad 44 and the second protrusion 42 is secured to the pad 44 along a top of the pad 44. The first protrusion 40 may also be secured to a side of the second protrusion 42. The pad 44 has a bottom surface 46 configured to engage the upper surface 16 of the cooking appliance 10.

The first protrusion 40 may be substantially perpendicular to the second protrusion 42. Substantially perpendicular may refer to any incremental angle that is between exactly perpendicular and 15° from exactly perpendicular. The first protrusion 40 and the second protrusion 42 may each by cylindrical in shape. The pad 44 may be wedge-shaped and may taper in direction that extends upward and toward the second protrusion 42. The pad 44 and the second protrusion 42 may collectively form a profile that is shaped like a key-hole.

Referring now to FIGS. 7-11, the engagement between the support 30 and the grate 28 are illustrated. The cavity 38 includes a first portion 48, a second portion 50, and a third portion 52. The first protrusion 40 is disposed within the first portion 48, the second protrusion 42 is disposed within the second portion 50, and the pad 44 is disposed within the third portion 52.

The first portion 48 and the second portion 50 of the cavity 38 are respectively shaped to interact with the first protrusion 40 and the second protrusion 42 of the support foot 30 to restrict movement of the support foot 30 in a first direction 54 and a second direction 56, respectively, relative to the grate 28. Stated in other terms, the first protrusion 40 and the second protrusion 42 of the support foot 30 are configured to engage a first internal surface 58 and second internal surface 60 of the grate 28 within the first portion 48 and the second portion 50 of the cavity 38, respectively, to restrict movement of the support foot 30 in the first direction 54 and the second direction 56, respectively, relative to the grate 28.

The first portion 48 of the cavity 38 includes an upper pocket 62 that is positioned above and offset from the second portion 50 of the cavity 38. The upper pocket 62 is configured to interact with a top portion 64 of first protrusion 40 to restrict movement of the support foot 30 in the first direction 54. Statin in other terms, the top portion 64 of first protrusion 40 engages the first internal surface 58 within the upper pocket 62 to restrict movement of the base support in the first direction 54.

The first direction 54 may be a horizontal direction and the second direction 56 may be a vertical direction, particularly when the bottom surface 46 of the support foot is engaging the upper surface 16 of the cooking appliance 10. Also, the first protrusion 40 may extend vertically and the second protrusion 42 may extend horizontally, particularly when the bottom surface 46 of the support foot is engaging the upper surface 16 of the cooking appliance 10 and when the support foot 30 is disposed within the cavity 38.

The support foot 30 may be comprised of a soft plastic or rubber material while the grate 28 may be comprised of material that is more rigid relative to the support foot 30, such as a metallic material (e.g., iron, steel, stainless steel, aluminum). More specifically, the support foot 30 may be elastic or flexible so that the support foot 30 may flex during installation so that each section (e.g., first protrusion 40, second protrusion 42, and support pad 44) of the support foot 30 may be transitioned into a desired portion (e.g., first portion 48, second portion 50, and third portion 52) of the cavity 38. The support foot 30, however, may also be resilient so that it may return to an original or initial shape after installation is complete.

Also, the bottom surface 46 of the pad 44 is disposed below the one or more lower surfaces 32 of the grate 28 so that the soft material comprising the support foot 30 engages the upper surface 16 of the cooking appliance 10 in order to prevent the grate 28 from scratching the upper surface 16 of the cooking appliance 10, which may be made from a finished metallic or painted material.

During installation of the support foot 30 into the cavity 38, the engagement between the first protrusion 40 and the first portion 48 of the cavity 38 may act as a guide while the support foot 30 is being pushed upwards into the cavity 38. A third internal surface 66 of the grate 28 that defines the third portion 52 of the cavity 38 may be wedge-shaped and may act to compress the second protrusion 42 while the second protrusion 42 is being pushed upward during installation. An intersection between the second portion 50 and the third portion 52 of the cavity 38 may form a bottleneck 68. Once the second protrusion 42 moves upward past the bottleneck 68 and into the second portion 50 of the cavity 38 during installation, the second protrusion 42 returns to its original shape due to the resiliency of the material that support foot 30 foot is constructed from. Once the second protrusion 42 returns to its original shape, the cross-sectional shape of the second protrusion 42 is wider than the bottleneck 68. The bottleneck 68 then acts to restrict down movement of the second protrusion 42.

The restricted vertical movement of the support foot 30 (caused by the interference between the second protrusion 42 and the bottleneck 68) and the restricted horizontal movement of the support foot 30 (caused by the interference between the top portion 64 of the first portion 40 and the first internal surface 58 within the upper pocket 62) acts to retain support foot 30 within the internal cavity 38 eliminating the need for the use fasteners or adhesive to fix the position of the support foot 30 within the internal cavity 38. Furthermore, the wedge-shape of the third internal surface 66 allows for ease of installation by compressing the second protrusion 42 during installation. On the other hand, the bottleneck 68 acts to prevent downward movement of the second protrusion 42 and therefore ultimately acts to prevent removal of the support foot 30 from the cavity 38 once installed. More specifically, the downward pulling force required to remove the support foot 30 from the cavity 38 exceeds the pushing force required to install the support foot 30 into the cavity 38 because a ledge 70 formed within the second portion 50 of the cavity 38 (which engages the second protrusion 42 once disposed within the second portion 50 of the cavity 38) extends away from the bottleneck 68 at a steeper angle relative to an angle at which the wedge-shaped third internal surface 66 extends toward from the bottleneck 68 within the third portion 52 of the internal cavity 38. This ensures the support 30 remains within the cavity 38 once installed.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A cooking vessel support for a burner comprising:

a grate having (i) a top surface configured to support a cooking vessel and (ii) at least one lower surface configured for disposal along an upper surface of a cooking appliance, wherein the at least one lower surface defines a plurality of cavities, each cavity extending upward from the at least one lower surface and into the grate, and each cavity having first, second, and third portions; and a plurality of base supports each (i) disposed within a respective cavity of the plurality of cavities, (ii) having a column disposed within the first portion of the respective cavity, (ii) having a beam disposed within the second portion of the respective cavity, and (iv) having a pad disposed within the third portion of the respective cavity, wherein each pad (i) extends outward from a side of a respective column, (ii) extends downward from a bottom of a respective beam, and (iii) has a bottom surface configured to engage the upper surface of the cooking appliance, wherein the first and second portions of each cavity are respectively shaped to interact with the column and the beam of a respective base support of the plurality of base supports to respectively restrict horizontal movement and vertical movement of the respective base support, and wherein intersections between the second and third portions of each cavity form bottlenecks configured to restrict downward movement of the beams.

2. The cooking vessel support of claim 1, wherein the column and beam within each base support are substantially perpendicular to each other.

3. The cooking vessel support of claim 2, wherein each beam and each column are cylindrical in shape, and wherein each pad is wedge-shaped and tapers in a direction that extends upward.

4. The cooking vessel support of claim 1, wherein the bottom surface of each pad is disposed below the at least one lower surface of the grate.

5. The cooking vessel support of claim 1, wherein the first portion of each cavity includes an upper pocket that is positioned above and offset from the second portion of the cavity, and wherein each pocket is configured to interact with a top portion of one of the columns to restrict horizontal movement of one of the base supports.

6. The cooking vessel support of claim 1, wherein the grate includes a hub and spokes protruding outward from the hub, and wherein each cavity is defined by one of the spokes.

7. A cooking vessel support for a burner comprising:

a grate having (i) a top surface configured to support a cooking vessel and (ii) a lower surface configured for disposal along an upper surface of a cooking appliance, the lower surface defining a cavity, wherein the cavity extends upward from the lower surface and into the grate;

a support foot (i) disposed within the cavity, (ii) having a first protrusion disposed within a first portion of the cavity, (iii) having a second protrusion disposed within a second portion of the cavity, and (iv) having pad disposed within a third portion of the cavity, wherein (i) the first protrusion is secured to the pad along a side of the pad, (ii) the second protrusion is secured to the pad along a top of the pad, (iii) the pad has a bottom surface configured to engage the upper surface of the cooking appliance, and (iv) the first and second protrusions are configured to engage first and second internal surfaces of the grate within the first and second portions of the cavity, respectively, to restrict movement of the support foot in first and second directions, respectively, and wherein an intersection between the second and third portions of the cavity forms a bottleneck configured to restrict downward movement of the second protrusion.

8. The cooking vessel support of claim 7, wherein the first direction is a horizontal direction.

9. The cooking vessel support of claim 7, wherein the second direction is a vertical direction.

10. The cooking vessel support of claim 7, wherein the first and second protrusions are substantially perpendicular to each other.

11. The cooking vessel support of claim 7, wherein the first and second protrusions are cylindrical in shape, and wherein the pad is wedge-shaped and tapers in a direction that extends upward.

12. The cooking vessel support of claim 7, wherein the bottom surface of the pad is disposed below the lower surface of the grate.

13. The cooking vessel support of claim 7, wherein the first portion of the cavity includes an upper pocket that is positioned above and offset from the second portion of the cavity, and wherein a top portion of the first protrusion engages the first internal surface within the upper pocket to restrict movement of the support foot in the first direction.

14. The cooking vessel support of claim 7, wherein the grate includes a hub and spokes protruding outward from the hub, and wherein the cavity is defined by one of the spokes.

15. A cooktop grate support foot comprising:

a resting pad having a bottom surface configured to engage an upper surface of a cooking appliance;

a beam secured to a top of the resting; and extending over an entirety of the top of the resting pad; and a column secured to a lateral side of the resting pad, secured to a lateral side of the beam, and extending over entireties of the lateral sides of the resting pad and beam from the bottom surface of the resting pad to a top of the beam, wherein the beam and the column are configured to engage internal surfaces defined within an orifice of a cooktop grate to restrict movement of the cooktop grate support foot in first and second directions relative to the cooktop grate, respectively.

16. The cooktop grate support foot of claim 15, wherein the first and second protrusions are cylindrical in shape, and wherein the resting pad is wedge-shaped and tapers in a direction that extends upward.

17. The cooktop grate support foot of claim 15, wherein the column further extends above and beyond the top of the beam.

18. The cooktop grate support foot of claim 15, wherein a bottom surface of the column is coplanar with the bottom surface of the resting pad, and wherein the bottom surface of the column and the bottom surface of the resting pad collectively define a bottom surface of the cooktop grate support foot as a whole.

* * * * *